US008272901B2

(12) United States Patent
Rossman

(10) Patent No.: US 8,272,901 B2
(45) Date of Patent: Sep. 25, 2012

(54) CRIMP CONTACTS AND ELECTRICAL CONNECTOR ASSEMBLIES INCLUDING THE SAME

(75) Inventor: Jared Evan Rossman, Dover, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 186 days.

(21) Appl. No.: 12/887,187

(22) Filed: Sep. 21, 2010

(65) Prior Publication Data

US 2012/0071031 A1 Mar. 22, 2012

(51) Int. Cl.
*H01R 24/00* (2006.01)

(52) U.S. Cl. ..... 439/660

(58) Field of Classification Search ..... 439/660, 439/877, 851, 693, 318, 843, 879, 730, 885, 439/932, 878, 856, 357
See application file for complete search history.

(56) References Cited

U.S. PATENT DOCUMENTS

| | | | | |
|---|---|---|---|---|
| 3,601,783 | A * | 8/1971 | Loose | 439/730 |
| 5,015,195 | A * | 5/1991 | Piriz | 439/318 |
| 5,213,517 | A * | 5/1993 | Kerek et al. | 439/187 |
| 5,529,517 | A * | 6/1996 | Hopf et al. | 439/843 |
| 5,533,914 | A * | 7/1996 | Sawada | 439/843 |
| 5,588,852 | A * | 12/1996 | Puerner | 439/135 |
| 6,186,841 | B1 * | 2/2001 | Jacobsson | 439/851 |
| 6,250,974 | B1 * | 6/2001 | Kerek | 439/843 |
| 7,115,003 | B2 * | 10/2006 | Zhao et al. | 439/851 |
| 7,115,004 | B2 * | 10/2006 | Takayama | 439/852 |
| 7,207,850 | B2 * | 4/2007 | Takayama | 439/852 |
| 7,252,559 | B1 * | 8/2007 | Morello et al. | 439/843 |
| 7,252,564 | B1 * | 8/2007 | Morello et al. | 439/877 |
| 7,318,758 | B2 * | 1/2008 | Haller | 439/843 |
| 7,338,334 | B2 * | 3/2008 | Kumakura | 439/866 |
| 7,494,388 | B2 * | 2/2009 | Kakuta | 439/879 |
| 2004/0116002 | A1 * | 6/2004 | Rozet et al. | 439/843 |
| 2004/0224573 | A1 * | 11/2004 | Yoshida et al. | 439/852 |

OTHER PUBLICATIONS

ELCON Drawer Series Connectors, Tyco Electronics, Application Specification 114-13206, Jun. 16, 2010, Rev D, 17pgs.
ELCON Drawer Series, Contact, Socket, Part No. 6648418-1, 1 pg.

* cited by examiner

*Primary Examiner* — Alexander Gilman

(57) ABSTRACT

A crimp contact including a first component that has opposite leading and trailing ends and a central axis that extends therebetween. The first component has a component wall that includes an interior surface and a wall edge. The interior surface defines a contact passage that extends along the central axis. The wall edge defines a passage opening at the trailing end. The crimp contact also includes a second component coupled to the first component. The second component includes a sheet wall that has body and sleeve portions joined together along a wall joint. The body portion is located within the contact passage and extends about the central axis to define a crimping cavity. The sleeve portion is folded over the body portion at the wall joint so that the sleeve and body portions define a radial gap therebetween. The component wall is located within the radial gap.

20 Claims, 6 Drawing Sheets

CRIMP CONTACTS AND ELECTRICAL CONNECTOR ASSEMBLIES INCLUDING THE SAME

BACKGROUND OF THE INVENTION

The subject matter herein relates generally to electrical contacts and, more specifically, to crimp contacts that are deformed to grip one or more conductors and establish an electrical connection.

Conventional crimp contacts include a mating end that electrically engages a mating contact and a loading end that includes a passage configured to receive one or more conductors (e.g., a stripped cable wire). Using a crimping tool, the crimp contact may be compressed or deformed at the loading end thereby causing the crimp contact to grip the conductors within the conductor passage and establish an electrical connection. The deformed crimp contact (or crimped contact) may then be inserted into a contact cavity of a connector housing where the crimped contact is positioned to engage the mating contact from another connector.

Dimensions of crimp contacts may be set by industry or customer-specified requirements. For example, an outer diameter of the crimp contact may be sized so that a crimping tool may engage the crimp contact and compress the crimp contact in a predetermined manner. An inner diameter that defines the conductor passage may be sized to effectively engage the conductor when the crimp contact is deformed. In order to satisfy the industry or customer-specified dimensions, crimp contacts are typically machined. For example, a conductive material in the form of a block or rod may be machined (e.g., by a screw machine) to form the conductor passage of the crimp contact as well as other features. Such crimp contacts may be called screw-machine contacts. However, these manufacturing methods may be costly to perform and inefficient since the removed conductive material (i.e., waste material) is no longer usable.

Accordingly, there is a need for crimp contacts that may be manufactured in a less costly manner than some known processes for manufacturing crimp contacts.

BRIEF DESCRIPTION OF THE INVENTION

In one embodiment, a crimp contact is provided that includes a first component having opposite leading and trailing ends and a central axis that extends therebetween. The first component has a component wall that includes an interior surface and a wall edge. The interior surface defines a contact passage that extends along the central axis. The wall edge defines a passage opening into the contact passage at the trailing end. The crimp contact also includes a second component that is coupled to the first component. The second component has a sheet wall that includes body and sleeve portions joined together along a wall joint. The body portion is located within the contact passage and extends about the central axis to define a crimping cavity that is accessible through the trailing end. The sleeve portion is folded over the body portion at the wall joint so that the sleeve and body portions define a radial gap therebetween that extends peripherally about the central axis. The component wall is located within the radial gap.

In another embodiment, a crimp contact is provided that has opposite mating and loading ends and a central axis extending therebetween. The crimp contact includes a first component that includes an elongated body that extends in a direction along the central axis. The first component has an interior surface that defines a contact passage extending between and through the mating and loading ends. The crimp contact also including a second component that includes a sheet wall shaped to extend around the central axis to define a crimping cavity at the loading end. The sheet wall has an outer surface proximate to the mating end that faces radially away from the central axis. The second component is received within the contact passage. The outer surface of the sheet wall and the interior surface of the first, component define a contact-receiving space therebetween proximate to the mating end. The sheet wall and the first component are deformable proximate to the loading end to grip a conductor within the crimping cavity.

In another embodiment, an electrical connector assembly is provided that includes a connector housing having opposite mounting and mating sides. The connector housing includes a plurality of contact cavities that extend therethrough between the mounting and mating sides. The connector assembly also includes a plurality of crimp contacts that are held within corresponding contact cavities. Each of the crimp contacts includes a first component having opposite leading and trailing ends and a central axis that extends therebetween. The first component has a component wall that includes an interior surface and a wall edge. The interior surface defines a contact passage that extends along the central axis. The wall edge defines a passage opening into the contact passage at the trailing end. The crimp contact also includes a second component that is coupled to the first component. The second component has a sheet wall that includes body and sleeve portions joined together along a wall joint. The body portion is located within the contact passage and extends about the central axis to define a crimping cavity that is accessible through the trailing end. The sleeve portion is folded over the body portion at the wall joint so that the sleeve and body portions define a radial gap therebetween that extends peripherally about the central axis. The component wall is located within the radial gap.

DETAILED DESCRIPTION OF THE INVENTION

Figure 1:
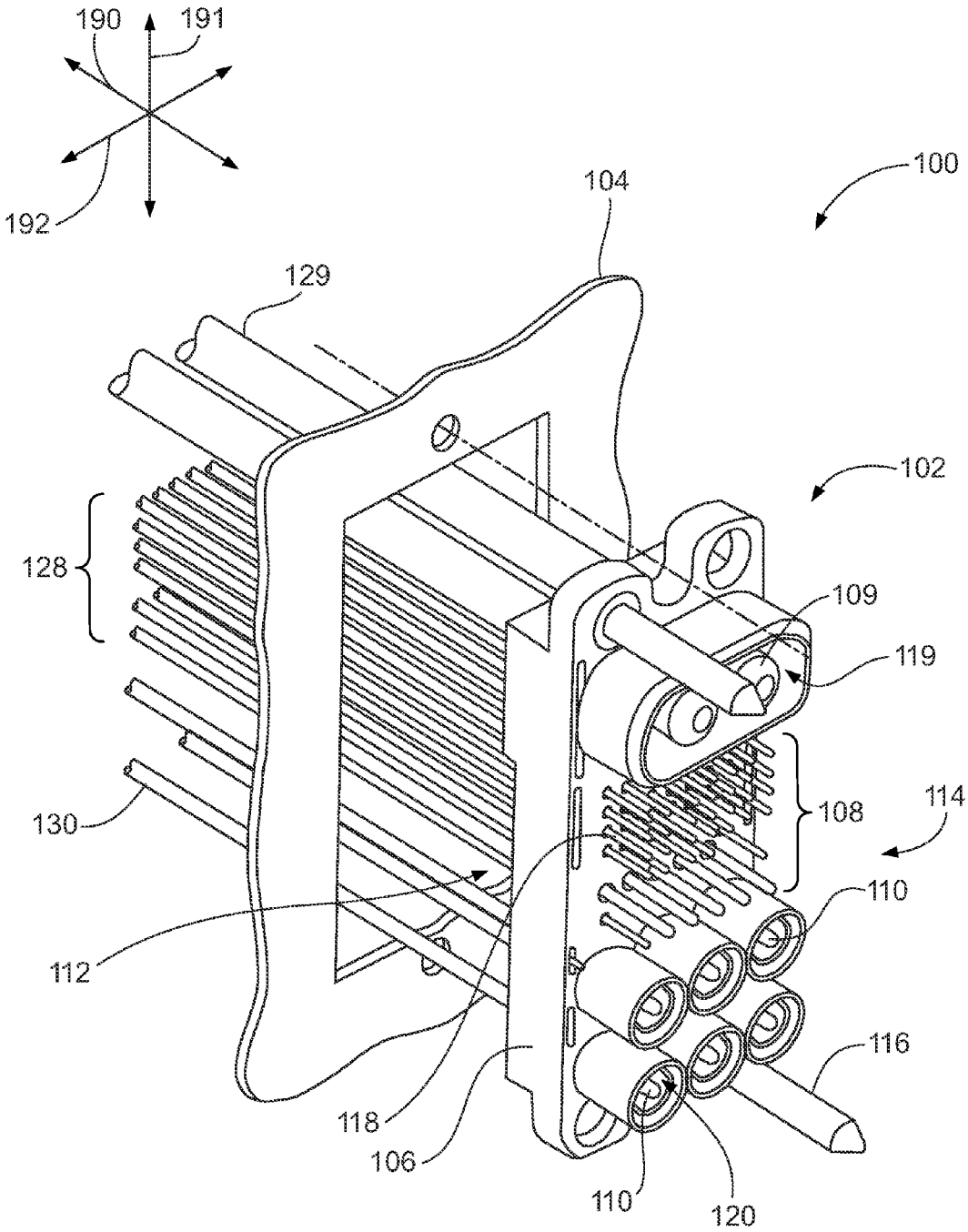
FIG. 1 is an exploded perspective view of an electrical system that includes an electrical connector assembly formed in accordance with one embodiment.

FIG. 1 is an exploded perspective view of an electrical system 100 that includes an electrical connector assembly 102 that is formed in accordance with one embodiment. The connector assembly 102 is configured to be mounted to a support structure 104 of the electrical system 100. In the illustrated embodiment, the support structure 104 includes a circuit board. However, in alternative embodiments, the support structure 104 may include a panel or other structural support that is capable of having the connector assembly 102 mounted thereto. The connector assembly 102 may be configured to communicatively engage or mate with a mating connector (not shown). For example, the connector assembly 102 may be used in pluggable wire-to-board applications and may be configured to transmit electrical data signals and power.

The connector assembly 102 includes a connector housing 106 comprising an insulative material and electrical contacts 108-110 that are held by the connector housing 106. As shown, the connector assembly 102 is oriented with respect to mutually perpendicular axes 190-192 (also referred to as a longitudinal axis 190 and lateral axes 191 and 192). The connector housing 106 includes opposite mounting and mating sides 112 and 114. The mounting side 112 is configured to be mounted to the support structure 104, and the mating side 114 is configured to engage the mating connector. The connector housing 106 is configured to hold the electrical contacts 108-110 in predetermined orientations so that the electrical contacts 108-110 may electrically engage corresponding mating contacts (not shown) of the mating connector. For example, the connector housing 106 may include contact cavities 118-120 that extend axially through the connector housing 106 (e.g., in a direction along the longitudinal axis 190). The contact cavities 118-120 may be shaped to hold the electrical contacts 108-110 in the predetermined orientations. The connector assembly 102 may also include other features, such as guide pins 116, which may facilitate engaging the mating connector.

The electrical contacts 108-110 are configured to electrically connect with corresponding conductors 128-130, respectively. The conductors 128-130 may be single conductors or a plurality of conductors that are, for example, grouped together within a cable. Before the electrical contacts 108-110 are disposed within the corresponding contact cavities 118-120, the electrical contacts 108-110 may be electrically coupled or connected to the respective conductors 128-130. By way of example only, the electrical contact 108 may be a solder-type contact in which a loading end of the electrical contact 108 is soldered to the conductor 128. The electrical contacts 109 and 110 may be crimp-type contacts in which corresponding crimping cavities (not shown) of the electrical contacts 109 and 110 receive the conductors 129 and 130. After interconnecting the conductors 128-130 to the corresponding electrical contacts 108-110, the electrical contacts 108-110 may be inserted into the respective contact cavities 118-120. In alternative embodiments, the electrical contacts 108-110 may be positioned within the respective contact cavities 118-120 before the conductors 128-130 are electrically connected. The electrical contacts 108-110 may couple to the connector housing 106 so that the electrical contacts 108-110 are held in fixed positions with respect to the connector housing 106. For example, the connector housing 106 may have various elements or features that form an interference fit with the electrical contacts 108-110.

Embodiments described herein include crimp contacts, such as the electrical contacts 109 and 110, which are configured to electrically engage corresponding conductors at loading ends of the crimp contacts. Embodiments also include electrical connector assemblies that include such crimp contacts. The crimp contacts may include a plurality of layers or walls that extend around a central axis and form an interface between each other. The walls (or layers) may form a crimp portion of the crimp contact that receives a conductor. The walls may have predetermined dimensions. The crimp portion is configured to be compressed or deformed radially inward by a crimping tool so that one of the walls grips the conductors. In some embodiments, the walls may be formed from a continuous sheet of material. The sheet of material may be folded along a wall joint or somehow shaped to form the crimp portion of the crimp contact. In some embodiments, the walls may be separate components.

Figure 2:
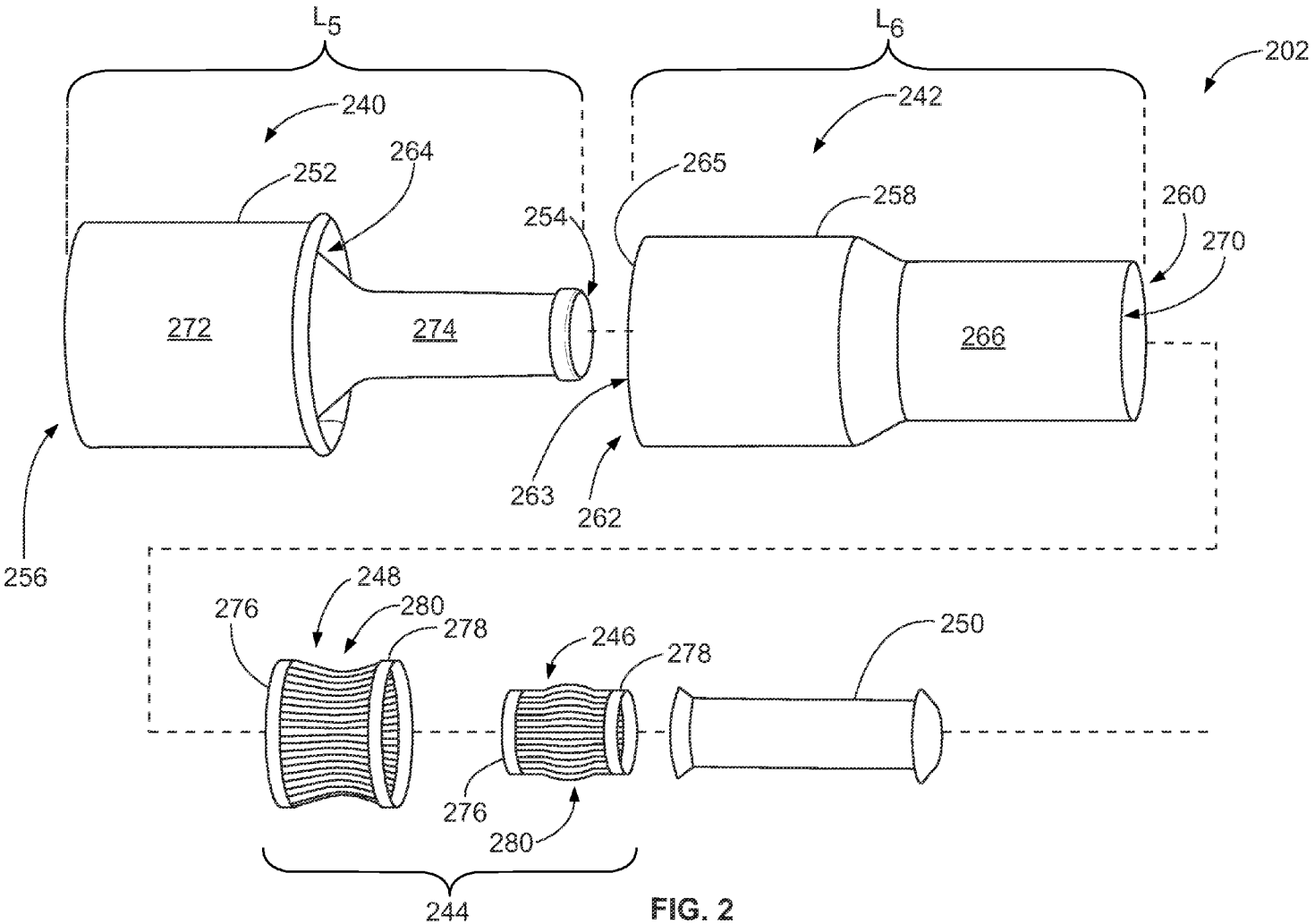
FIG. 2 is an exploded view of a crimp contact formed in accordance with one embodiment that may be used with the connector assembly of FIG. 1.

FIG. 2 is an exploded view of a crimp contact 202. As shown, the crimp contact 202 may include an assembly of various parts and components, such as a contact component (or first component) 242, a stamped component (or second component) 240, a conductive band member 244 that may include inner and outer bands 246 and 248, and a plug insert 250. The stamped component 240 has an elongated body 252 that extends longitudinally between opposite leading and trailing ends (or first and second ends) 254 and 256. The elongated body 252 has a length $L_5$ that is measured from the leading end 254 to the trailing end 256. The stamped component 240 has an outer surface 272 proximate to the trailing end 256 and an outer surface 274 proximate to the leading end 254.

Figure 6:
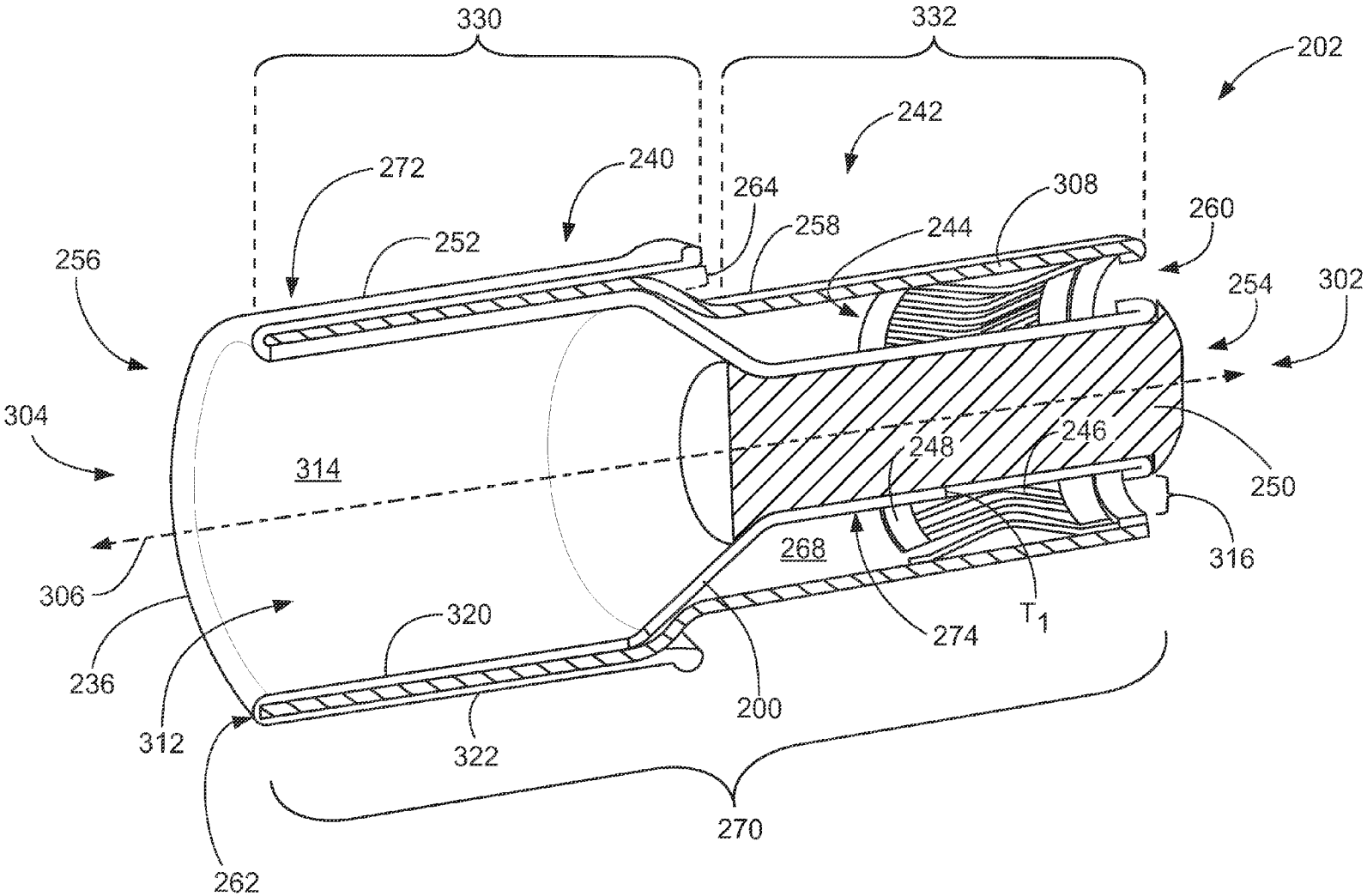
FIG. 6 is a perspective view of a cross-section of the crimp contact of FIG. 2.

The contact component 242 has an elongated body 258 that extends longitudinally between opposite leading and trailing ends (or first and second ends) 260 and 262. The contact component 242 may be a drawn component that is manufactured during a drawing process or operation. In particular embodiments, the contact component 242 may comprise only a single continuous element that is shaped using tensile forces. For example, a tubular element may be stretched and shaped such that different tubular portions have different diameters. As shown, the elongated body 258 has a length $L_6$ that is measured from the leading end 260 to the trailing end 262. In the illustrated embodiment, the lengths $L_6$ and $L_5$ are approximately equal. The contact component 242 has an exterior surface 266 and an interior surface 268 (FIG. 6). The interior surface 268 defines a contact passage 270 that extends between and through the leading and trailing ends 260 and 262. The contact component 242 may have a wall edge 265 that defines a passage opening 263 at the trailing end 262. The passage opening 263 provides access to the contact passage 270. Also, as will be described in greater detail below, the stamped component 240 may have a radial gap 264 that is sized and shaped to receive the trailing end 262 of the contact component 242.

Also shown in FIG. 2, each of the inner and outer bands 246 and 248 includes first and second collars 276 and 278 and a plurality of flex members 280 extending therebetween. The first and second collars 276 and 278 of the outer band 248 are sized and shaped to engage the interior surface 268 of the contact component 242, and the first and second collars 276 and 278 of the inner band 246 are sized and shaped to engage the outer surface 274 of the stamped component 240. However, in alternative embodiments, the band member 244 may include only a single band. Furthermore, in other embodiments, the crimp contact 202 may function without a band member. Also shown in FIG. 2, the plug insert 250 comprises an insulative material that may be sized and shaped to form an interference fit with the stamped component 240.

Figure 3:
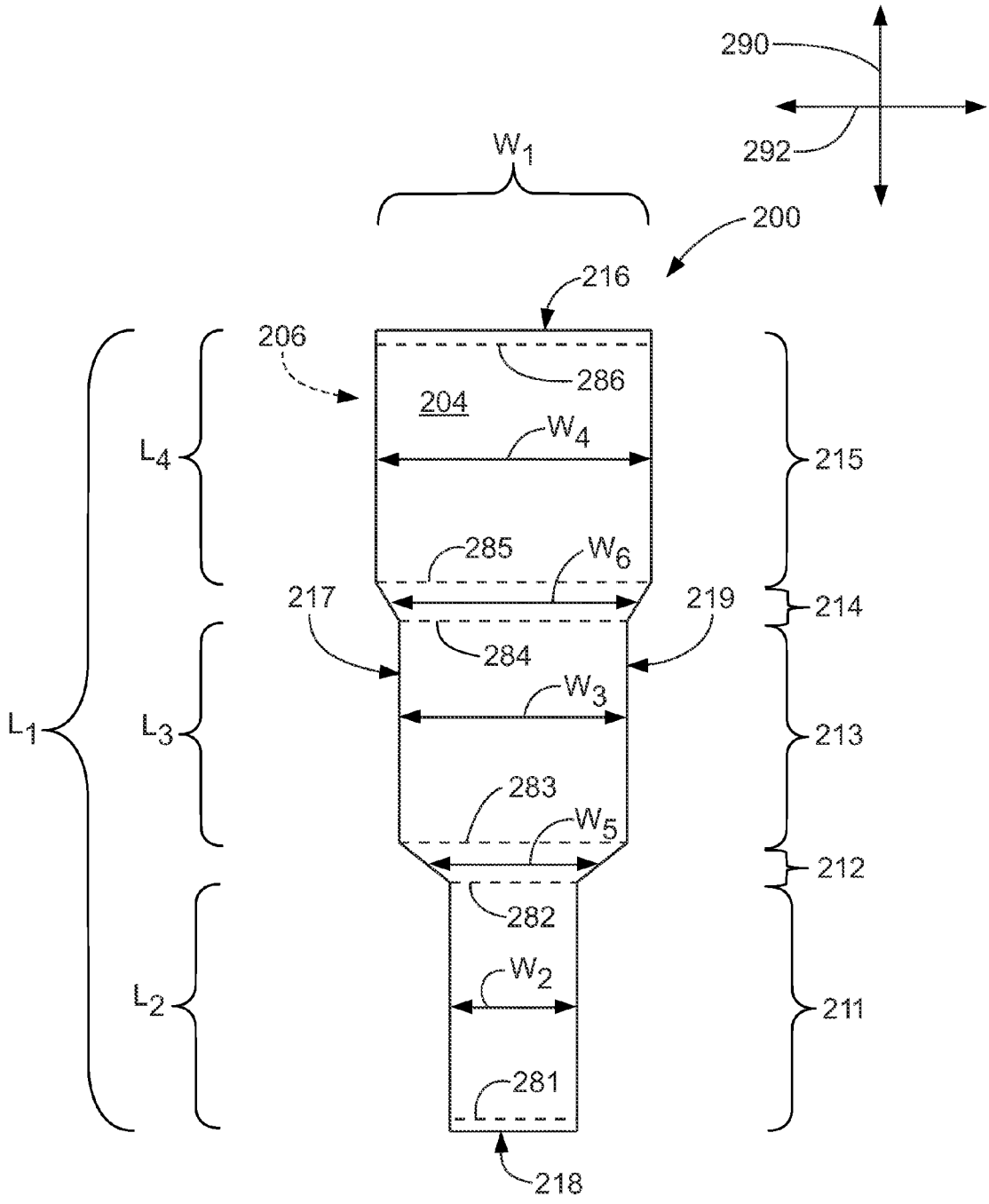
FIG. 3 is a plan view of a sheet wall that may be used to form a stamped component of the crimp contact of FIG. 2.

FIG. 3 is a plan view of a sheet wall (or contact sheet) 200 that may be shaped to form the stamped component 240 (shown in FIG. 2). The sheet wall 200 is oriented with respect to a longitudinal sheet axis 290 and a lateral sheet axis 292. The sheet wall 200 has a sheet length $L_1$ and a sheet width $W_1$. As shown, the sheet wall 200 is defined between side edges 216-219 and may include a plurality of sheet sections 211-215. The sheet sections 211-215 may be coupled to each other in a series and arranged side-by-side along the longitudinal sheet axis 290 between opposite side edges 217 and 219. The sheet wall 200 may comprise one or more materials. In the illustrated embodiment, the sheet wall 200 comprises a solid material that is malleable or capable of being formed (e.g., through rolling, bending, folding, and the like) into a predetermined shape. As shown, the sheet sections 211-215 may have section borders 281-286 that indicate where the sheet wall 200 may be folded, bent, rolled, or somehow shaped. The section borders 281-286 may also be referenced as fold lines or areas.

In the illustrated embodiment, the sheet wall 200 is a continuous structure such that the sheet sections 211-215 are not separate parts. For example, the sheet wall 200 may be stamped from a larger sheet of conductive material. The sheet of material may comprise one type of solid material such that the sheet wall 200 is a common solid material throughout. In some embodiments, the sheet wall 200 is stamped and formed from a continuous sheet of conductive material. The sheet comprises a solid material that is malleable. By way of example only, the material may be a copper alloy plated with silver or gold.

The sheet of material is not required to comprise only one type of material. For example, the plurality of sheet sections 211-215 may comprise two or more different solid materials that are bonded together (e.g., through an adhesive, soldering, welding, or mechanical means) along the section borders 281-286. As another example, the sheet wall 200 may be manufactured so that the material has different properties in different areas or regions (or sheet sections). For example, a resin injected into a mold may have magnetic particles that are attracted to a predetermined area or region of the sheet wall 200. As another example, the sheet wall 200 may be plated.

Also shown, the sheet wall 200 may have opposite plan surfaces 204 and 206 where a thickness $T_1$ (shown in FIG. 6) of the sheet wall 200 extends therebetween. In the illustrated embodiment, the thickness $T_1$ may be substantially uniform throughout the sheet wall 200. In alternative embodiments, the thickness $T_1$ may be different at different portions of the sheet wall 200. For example, the sheet section 215 may have a thickness that is different from a thickness of the sheet section 213. Furthermore, the plan surfaces 204 and 206 may be modified in predetermined areas. For example, the plan surfaces 204 and 206 may have a chemical substance (e.g., adhesive) deposited thereon or may be machined, etched, or stamped to have predetermined surface properties or features.

As shown in FIG. 3, the side edges 216-219 are substantially linear without projections or recesses. However, in alternative embodiments, the side edges 216-219 may have predetermined elements or features that facilitate forming the sheet wall 200. For example, the side edge 217 may have coupling projections that project away from the sheet wall 200 in a direction along the lateral sheet axis 292. The side edge 219 may have corresponding coupling recesses that project into the sheet wall 200. The coupling recesses may be cut-outs that occur when the sheet wall 200 is stamped from the sheet of material. The coupling projections and recesses may be shaped relative to each other so that the corresponding coupling projections and recesses interlock with each other.

The sheet sections 211-215 may have predetermined sizes, dimensions, and shapes for forming the crimp contact 202. For example, the sheet sections 211, 213, and 215 may have axial lengths $L_2$, $L_3$, and $L_4$. The axial lengths $L_3$ and $L_4$ may be substantially equal. Also shown, the sheet sections 211, 213, and 215 may have respective widths $W_2$, $W_3$, and $W_4$. The width $W_4$ may be greater than the width $W_3$, which may be greater than the width $W_2$. Widths $W_5$ and $W_6$ of the sheet section 212 and 214, respectively, may gradually increase or decrease as the corresponding sheet sections 212 and 214 extend along the longitudinal sheet axis 290. When the sheet wall 200 is shaped, the different widths $W_2$, $W_3$, and $W_4$ may determine circumferences or perimeters of different portions of the stamped component 240.

In the illustrated embodiment, the sheet section 215 may be folded onto the sheet section 213 along the section borders 284 and 285 such that the plan surface 204 is folded onto itself (i.e., the plan surface 204 of the sheet section 215 faces the plan surface 204 of the sheet section 213). As such, the sheet section 214 may become a wall joint 236 (FIG. 5) of the stamped component 240. Furthermore, the sheet sections 211 and 212 may be bent or folded with respect to each other along the section border 282. The sheet sections 212 and 213 may be bent or folded with respect to each other along the section border 283. In this manner, the sheet sections 211 and 213 may be configured to extend parallel to each other before the sheet wall 200 is rolled or otherwise shaped.

The sheet wall 200 may be rolled about an axis (e.g., a central axis 306 shown in FIG. 4) to have a curved contour. The sheet wall 200 may be rolled about the central axis 306 so that the crimp contact 202 has a substantially circular cross-section. However, in alternative embodiments, the crimp contact 202 may have other geometrically shaped cross-sections. For example, the crimp contact 202 may have a cross-section that is substantially square, rectangular, or partially curved. When the sheet wall 200 is shaped about the central axis 306, the side edges 217 and 219 may directly abut each other along an interface 231 (shown in FIG. 5). The sheet wall 200 may define a crimping cavity 312 (shown in FIG. 6) therein.

However, the stamped and contact components 240 and 242 may be manufactured by other means. In such cases in which the claimed invention is not limited to having structural features related to or as a result of a certain manufacturing process, the stamped component 240 may be generally referred to as a second component. For example, such a second component may have features that are similar to the stamped component 240 as described herein, but may be manufactured through a screw-machining process and/or a drawing process or any other manufacturing process. Likewise, the contact component 242 may be manufactured by other means, such as through a stamp-and-form process and/or a screw-machining process or any other manufacturing process. The contact component 242 may be referred to as a first component.

Returning to FIG. 2, the crimp contact 202 may be assembled by inserting the leading end 254 of the stamped component 240 through the passage opening 263 of the contact component 242 so that the stamped component 240 is received with the contact passage 270. As the leading end 254 advances into the contact passage 270, the trailing end 262 of the contact component 242 may be received by the radial gap 264 of the stamped component 240. The stamped and contact components 240 and 242 may be coupled together by interference fit and/or an adhesive may be used to couple the stamped and contact components 240 and 242. The plug insert 250 may be inserted into the crimping cavity 312 of the stamped component 240 before, after, or during the coupling operation of the stamped and contact components 240 and 242. Likewise, the inner and outer bands 246 and 248 may be coupled to the stamped and contact components 240 and 242, respectively, at various times when the crimp contact 202 is assembled.

Figure 4:
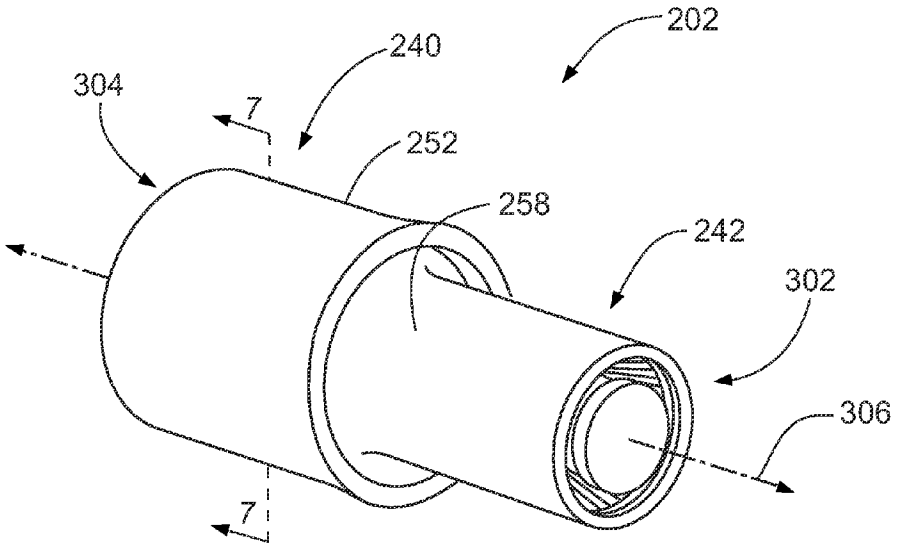
FIG. 4 is a perspective view of a mating end of the crimp contact of FIG. 2.
Figure 5:
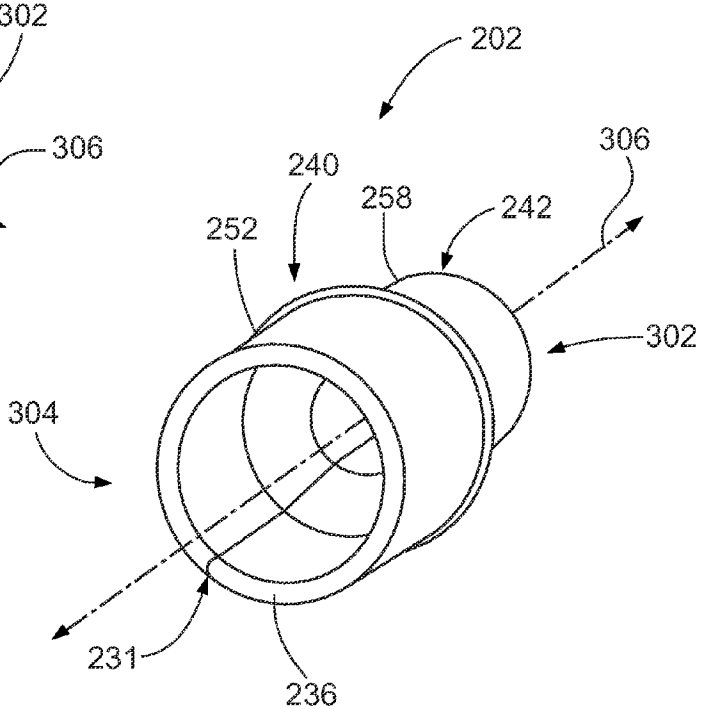
FIG. 5 is a perspective view of a loading end of the crimp contact of FIG. 2.

FIGS. 4-6 illustrate different views of the crimp contact 202 when fully assembled. FIGS. 4 and 5 provide perspective views of mating and loading ends 302 and 304, respectively. FIG. 6 is a perspective view of a longitudinal cross-section of the crimp contact 202. As shown, the mating and loading ends 302 and 304 are opposite of each other and have the central axis 306 extending therebetween. The elongated body 258 of the contact component 242 extends in a direction along the central axis 306. The elongated body 252 of the stamped component 240 also extends in a direction along the central axis 306. The stamped component 240 includes the sheet wall 200 (FIG. 6).

As shown in FIG. 6, when the crimp contact 202 is fully assembled, the leading ends 254 and 260 of the stamped and contact components 240 and 242, respectively, are proximate to the mating end 302 of the crimp contact 202, and the trailing ends 256 and 262 are proximate to the loading end 304. The contact component 242 includes a component wall 308 that is shaped to extend around the central axis 306. The component wall 308 includes the interior surface 268, which faces radially inward toward the central axis 306. Accordingly, in particular embodiments, the stamped and contact components 240 and 242 may be concentric with respect to the central axis 306.

Also shown in FIG. 6, the sheet wall 200 is shaped to extend around the central axis 306 to define the crimping cavity 312. The crimping cavity 312 is accessible through the loading end 304 and configured to receive one or more conductors. The conductors may be, for example, one of the conductors 128-130 shown in FIG. 1 and have insulative jackets stripped therefrom to expose conductive material. The crimping cavity 312 may be defined by an inner surface 314 of the stamped component 240. In the illustrated embodiment, the inner surface 314 is the plan surface 206 (FIG. 2) of the sheet wall 200 and faces radially inward toward the central axis 306 to define the crimping cavity 312. In the illustrated embodiment, the crimping cavity 312 extends between and through the mating and loading ends 302 and 304. Also shown, the outer surfaces 272 and 274 of the stamped component 240 face radially away from the central axis 306.

When the crimp contact is assembled, the stamped component 240 is received within the contact passage 270. The plug insert 250 may protrude beyond the leading end 260 of the contact component 242. As shown, the outer surface 274 of the sheet wall 200 and the interior surface 268 of the contact component 242 define a contact-receiving space 316 therebetween that is proximate to the mating end 302. In the illustrated embodiment, the contact-receiving space 316 is ring-shaped and surrounds the sheet wall 200 and the central axis 306. The plug insert 250 may have a rounded shape to facilitate directing the mating contact into the contact-receiving space 316.

In some embodiments, the conductive band member 244 is disposed within the contact-receiving space 316. The conductive band member 244 may be electrically connected to at least one of the stamped and contact components 240 and 242 and configured to electrically connect with a mating contact (not shown) of a mating connector to establish an electrical connection. As such, the crimp contact 202 may electrically interconnect the conductor in the crimping cavity 312 with the mating contact in the contact-receiving space 316.

In particular embodiments, the band member 244 includes the inner band 246, which engages to the outer surface 274 of the stamped component 240, and the outer band 248, which engages the interior surface 268 of the contact component 242. When the mating contact is advanced into the contact-receiving space 316, the flex members 280 (FIG. 2) of the inner and outer bands 246 and 248 may be engage the mating contact. The flex members 280 of the inner band 246 may be deflected radially inward, and the flex members 280 of the outer band 248 may be deflected radially outward. As such, the mating contact may be disposed between the inner and outer bands 246 and 248.

However, in alternative embodiments, only one of the inner and outer bands 246 and 248 may be located within the contact-receiving space 316. Furthermore, the band member 244 may be optional. For example, the crimp contact 202 may not include the band member 244 and the mating contact may be configured to directly contact at least one of the stamped and contact components 240 and 242 to establish an electrical connection.

Also shown in FIG. 6, the sheet wall 200 may include a body portion 320 and a sleeve portion 322 that are joined together along the wall joint 236. The sleeve portion 322 is folded along the wall joint 236 proximate to the loading end 304. The sleeve portion 322 extends alongside the body portion 320 and around the central axis 306. In particular embodiments, the sleeve portion 322 is folded over the body portion 320 so that the sleeve and body portions 322 and 320 define the radial gap 264 therebetween that extends peripherally about the central axis 306. More specifically, the sleeve portion 322 surrounds the body portion 320 about the central axis 306 such that the body portion 320 is closer to the central axis 306. The sheet wall 200 may be shaped along the wall joint 236 so that the radial gap 264 separates the sleeve portion 322 and the body portion 320. The component wall 308 may be located within the radial gap 264.

The stamped and contact components 240 and 242 proximate to the loading end 304 may constitute a crimp portion 330 of the crimp contact 202 since the sheet wall 200 and the component wall 308 proximate to the loading end 304 are configured to be deformed radially inward. The stamped and contact components 240 and 242 proximate to the loading end 304 may constitute an engagement portion 332 of the crimp contact 202 that is configured to engage the mating contact of the mating connector.

In alternative embodiments, the sleeve portion 322 may be folded along the wall joint 236 such that sleeve portion 322 extends alongside and immediately adjacent to the body portion 320 (i.e., without a radial gap or spacing therebetween). In such embodiments, the contact component 242 may surround the entire stamped component 240 and define the outer diameter proximate to the loading end 304.

Figure 7:
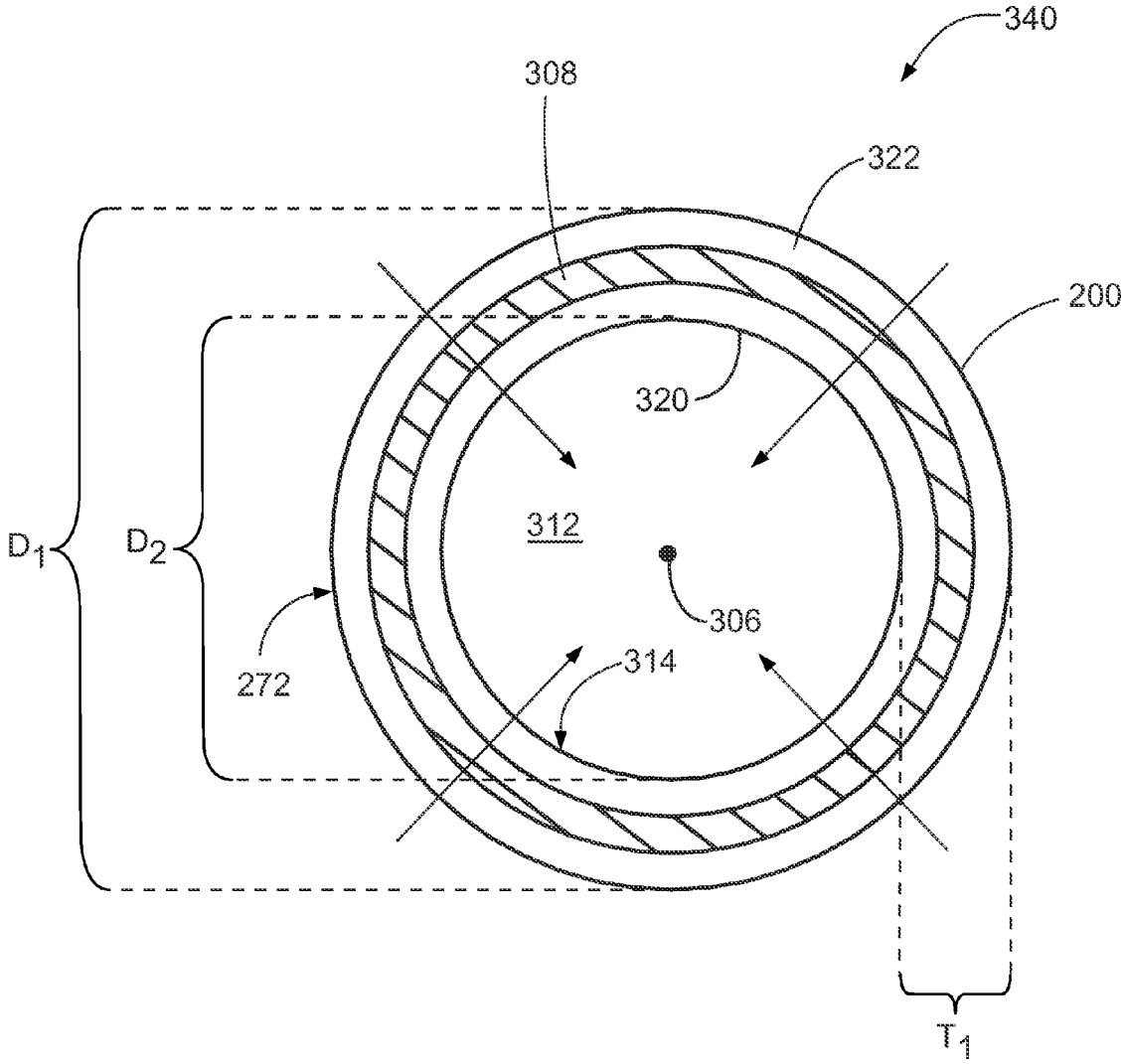
FIG. 7 is a cross section taken proximate to a loading end of the crimp contact along the lines 7-7 in FIG. 4.

FIG. 7 is a cross-section 340 taken perpendicular to the central axis 306 of the crimp portion 330 (FIG. 6). The sheet wall 200 and the component wall 308 may constitute a combined radial thickness $T_R$ of material of the crimp portion 330. In particular embodiments, the cross-section 340 includes the body portion 320 of the sheet wall 200, which is immediately surrounded by the component wall 308, which is immediately surrounded by the sleeve portion 322 of the sheet wall 200. The cross section 340 is shaped and the radial thickness $T_R$ is sized relative to dimensions of the conductor to grip the conductor when the sheet wall 200 and the component wall 308 are deformed radially inward by, e.g., a crimping tool (not shown). For example, four separate sections of the crimp contact 202 that are distributed about the central axis 306 may be pressed radially inward as indicated by the arrows. As such, the crimp portion 330 may electrically and mechanically engage the conductor at four separate areas within the crimping cavity 312.

Also shown in FIG. 7, the radial thickness $T_R$ may be measured between inner and outer diameters $D_2$ and $D_1$ of the crimp portion 330. The outer diameter $D_1$ may extend through the central axis 306 between different points of the outer surface 272. The outer diameter $D_1$ may be sized to accommodate predetermined crimping tools and/or so that the crimp portion 330 is deformed in a predetermined manner. The inner diameter $D_1$ may extend through the central axis 306 between different points of the inner surface 314. The inner diameter $D_1$ may represent a diameter of the crimping cavity 312. The inner diameter $D_2$ may be sized with respect to dimensions of the conductor in the crimping cavity 312 so that the crimp portion 330 effectively grips and makes electrical contact with the conductor.

Returning to FIG. 6, in some embodiments, a crimp contact 202 is provided that includes a first component 242 having opposite leading and trailing ends 260 and 262 and a central axis 306 that extends therebetween. The first component 242 has a component wall 308 that includes an interior surface 268 and a wall edge 265 (FIG. 1). The interior surface 268 defines a contact passage 270 that extends along the central axis 306. The wall edge 265 defines a passage opening 263 (FIG. 1) into the contact passage 270 at the trailing end 262. The crimp contact 202 also includes a second component 240 that is coupled to the first component 242. The second component 240 has a sheet wall 200 that includes body and sleeve portions 320 and 322 joined together along a wall joint 236. The body portion 320 is located within the contact passage 270 and extends about the central axis 306 to define a crimping cavity 312 that is accessible through the trailing end 262. The sleeve portion 322 is folded over the body portion 320 at the wall joint 236 so that the sleeve and body portions 322 and 320 define a radial gap 264 therebetween that extends peripherally about the central axis 306. The component wall 308 is located within the radial gap 264.

In some embodiments, a crimp contact 202 is provided that has opposite mating and loading ends 302 and 304 and a central axis 306 extending therebetween. The crimp contact 202 includes a first component 242 that includes an elongated body 258 that extends in a direction along the central axis 306. The first component 242 has an interior surface 268 that defines a contact passage 270 extending between and through the mating and loading ends 302 and 304. The crimp contact 202 also includes a second component 240 that includes a sheet wall 200 shaped to extend around the central axis 306 to define a crimping cavity 312 at the loading end 304. The sheet wall 200 has an outer surface 274 proximate to the mating end 302 that faces radially away from the central axis 306. The second component 240 is received within the contact passage 270. The outer surface 274 of the sheet wall 200 and the interior surface 268 of the first component 242 define a contact-receiving space 316 therebetween proximate to the mating end 302. The sheet wall 200 and the first component 242 are deformable proximate to the loading end 304 to grip a conductor, such as conductors 129 or 130 shown in FIG. 1, within the crimping, cavity 312.

Furthermore, an electrical connector assembly 102 as shown in FIG. 1 is provided that includes a connector housing 106 having opposite mounting and mating sides 112 and 114. The connector housing 106 includes a plurality of contact cavities 119 and/or 120 that extend therethrough between the mounting and mating sides 112 and 114. The connector assembly 102 also includes a plurality of electrical contacts 109 and/or 110 that are held within corresponding contact cavities 119 and/or 120. Each of the electrical contacts may be similar to the crimp contact 202 (FIG. 2) described above.

Thus, it is to be understood that the above description is intended to be illustrative, and not restrictive. In addition, the above-described embodiments (and/or aspects thereof) may be used in combination with each other. Furthermore, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A crimp contact comprising:

a first component including opposite leading and trailing ends and having a central axis that extends therebetween, the first component having a component wall that includes an interior surface and a wall edge, the interior surface defining a contact passage that extends along the central axis, the wall edge defining a passage opening into the contact passage at the trailing end; and a second component coupled to the first component, the second component comprising a sheet wall that includes body and sleeve portions joined together along a wall joint, the body portion being located within the contact passage and extending about the central axis to define a crimping cavity that is accessible through the trailing end, the sleeve portion being folded over the body portion at the wall joint so that the sleeve and body portions define a radial gap therebetween that extends peripherally about the central axis, the component wall being located within the radial gap.

2. The crimp contact in accordance with claim 1, wherein a cross section taken perpendicular to the central axis and proximate to the trailing end includes the sleeve and body portions of the sheet wall and the component wall.

3. The crimp contact in accordance with claim 2, wherein the sleeve and body portions of the sheet wall and the component wall form a combined radial thickness of material measured between inner and outer diameters, the inner diameter representing a diameter of the crimping cavity.

4. The crimp contact in accordance with claim 1, wherein the sheet wall is stamped and formed from a continuous sheet of a conductive material.

5. The crimp contact in accordance with claim 1, wherein the first component is a drawn component that comprises only a single continuous element.

6. The crimp contact in accordance with claim 1, wherein the sheet wall and the component wall are separated by a contact-receiving space at the leading end that is configured to receive a mating contact of an electrical component.

7. The crimp contact in accordance with claim 6 further comprising a conductive band member that is located within the contact-receiving space and is configured to engage the mating contact.

8. The crimp contact in accordance with claim 6, wherein the contact-receiving space has a ring shape.

9. The crimp contact in accordance with claim 1, wherein the sleeve and body portions and the component wall are concentric with respect to the central axis.

10. A crimp contact having opposite mating and loading ends and a central axis extending therebetween, the crimp contact comprising:

a first component comprising an elongated body that extends in a direction along the central axis, the first component having an interior surface that defines a contact passage extending between and through the mating and loading ends; and a second component comprising a sheet wall that is shaped to extend around the central axis to define a crimping cavity at the loading end, the sheet wall having an outer surface proximate to the mating end that faces radially away from the central axis;

wherein the second component is received within the contact passage, the outer surface of the sheet wall and the interior surface of the first component defining a contact-receiving space therebetween proximate to the mating end, the sheet wall and the first component being deformable proximate to the loading end to grip a conductor within the crimping cavity.

11. The crimp contact in accordance with claim 10, wherein the sheet wall comprises a body portion and a sleeve portion, the sleeve portion being folded over the body portion at the loading end so that the sleeve portion extends alongside the body portion and around the central axis.

12. The crimp contact in accordance with claim 11, wherein the sleeve portion surrounds the body portion about the central axis.

13. The crimp contact in accordance with claim 12, wherein the sleeve portion and the body portion are separated by a radial gap, the first component having a component wall that is received within the radial gap.

14. The crimp contact in accordance with claim 10, wherein a cross section taken perpendicular to the central axis and proximate to the loading end includes the sheet wall and the first component, the sheet wall and the first component forming a combined radial thickness of material configured to be deformed by a crimping tool.

15. The crimp contact in accordance with claim 10, wherein a cross section taken perpendicular to the central axis and proximate to the loading end includes the sheet wall and the first component, the first component and the sheet wall being concentric with respect to the central axis.

16. The crimp contact in accordance with claim 10, wherein the sheet wall is stamped and formed from a continuous sheet of a conductive material.

17. The crimp contact in accordance with claim 10, wherein the first component is a drawn component that comprises only a single continuous element.

18. The crimp contact in accordance with claim 10 further comprising a conductive band member located within the contact-receiving space that is configured to engage a mating contact of an electrical component.

19. An electrical connector assembly comprising:

a connector housing having opposite mounting and mating sides, the connector housing including a plurality of contact cavities extending therethrough between the mounting and mating sides; and a plurality of crimp contacts held within corresponding contact cavities, each of the crimp contacts comprising:

a first component including opposite leading and trailing ends and having a central axis that extends therebetween, the first component having a component wall that includes an interior surface and a wall edge, the interior surface defining a contact, passage that extends along the central axis, the wall edge defining a passage opening into the contact passage at the trailing end; and a second component coupled to the first component, the second component comprising a sheet wall that includes body and sleeve portions joined together along a wall joint, the body portion being located within the contact passage and extending about the central axis to define a crimping cavity that is accessible through the trailing end, the sleeve portion being folded over the body portion at the wall joint so that the sleeve and body portions define a radial gap therebetween that extends peripherally about the central axis, the component wall being located within the radial gap.

20. The connector assembly in accordance with claim 19, wherein the sheet wall and the component wall of each of the crimp contacts are separated by a contact-receiving space at the leading end that is configured to receive a mating contact of an electrical component.

* * * * *